US005391419A

United States Patent [19]

Davenport

[11] Patent Number: 5,391,419

[45] **Date of Patent: * Feb. 21, 1995**

[54] LOOP FORMATION IN ON-MACHINE-SEAMED PRESS FABRICS USING UNIQUE YARNS

[75] Inventor: Francis L. Davenport, Ballston Lake, N.Y.

[73] Assignee: Albany International Corp., Albany, N.Y.

[ * ] Notice: The portion of the term of this patent subsequent to Apr. 20, 2010 has been disclaimed.

[21] Appl. No.: 874,185

[22] Filed: Apr. 24, 1992

Related U.S. Application Data

[63] Continuation-in-part of Ser. No. 395,363, Aug. 17, 1989, Pat. No. 5,204,150.

[51] Int. Cl.[6] ..... B32B 23/02; B32B 5/06; D03D 23/00; D03D 15/00

[52] U.S. Cl. ..... 428/193; 139/383 AA; 139/420 R; 428/58; 428/229; 428/234; 428/300; 428/378; 428/375; 428/909

[58] Field of Search ..... 428/234, 235, 58, 222, 428/229, 230, 231, 233, 236, 245, 257, 258, 259, 373, 375, 474.4, 475.5, 909, 193, 234, 300, 378

[56] References Cited

U.S. PATENT DOCUMENTS

| | | | |
|---|---|---|---|
| 4,119,753 | 10/1978 | Smart | 428/234 |
| 4,119,754 | 10/1978 | Gisbourne | 428/255 |
| 4,144,371 | 3/1979 | Okie | 428/255 |
| 4,151,323 | 4/1979 | Christie | 428/235 |
| 4,315,049 | 2/1982 | Fickers | 428/104 |
| 4,327,779 | 5/1982 | Westhead | 390/383 A |
| 4,359,501 | 11/1982 | Di Tullio | 428/245 |
| 4,433,493 | 2/1984 | Poisson | 34/116 |
| 4,439,481 | 3/1984 | Johnson | 428/235 |
| 4,482,601 | 11/1984 | Hartigan | 428/234 |
| 4,489,125 | 12/1984 | Gagnon | 428/235 |
| 4,520,059 | 5/1985 | Worrall | 428/109 |
| 4,532,275 | 7/1985 | Aito | 523/468 |
| 4,533,594 | 8/1985 | Buchanan | 428/236 |
| 4,695,498 | 9/1987 | Sarrazin | 428/121 |
| 4,764,417 | 8/1988 | Gulya | 428/222 |
| 4,798,760 | 1/1989 | Diaz-Kotti | 428/234 |
| 4,830,915 | 5/1989 | Diaz-Kotti | 428/110 |
| 4,877,847 | 10/1989 | Masu | 525/397 |
| 4,892,781 | 1/1990 | Penven | 428/234 |
| 4,911,683 | 3/1990 | Legge | 474/255 |
| 5,005,610 | 4/1991 | Davenport | 428/222 |
| 5,204,150 | 4/1993 | Davenport | 428/58 |

*Primary Examiner*—James D. Withers
*Attorney, Agent, or Firm*—Kane, Dalsimer, Sullivan, Kurucz, Levy, Eisele and Richard

[57] ABSTRACT

A press fabric for use on papermaking and similar machines is of the open-ended variety, and has loops at each end enabling it to be closed into endless form during installation on the machine by means of a pin seam. The machine-direction (MD) yarns, from which the loops are formed during the flat or endless weaving of the fabric, are composite yarns having a core yarn with a sleeve-like coating. The coating, either permanent, semi-permanent, or soluble, gives the composite yarn a monofilament-like structure enabling good loop formation and stability. The use of multifilament yarn as the core yarn provides a fabric having improved elasticity in the machine direction, and a greater degree of resiliency, following the removal of a soluble coating material, than can be obtained using monofilament yarn.

11 Claims, 2 Drawing Sheets

LOOP FORMATION IN ON-MACHINE-SEAMED PRESS FABRICS USING UNIQUE YARNS

This is a continuation-in-part of application(s) Ser. No. 07/395,363, filed on Aug. 17, 1989, U.S. Pat. No. 5,204,150.

BACKGROUND OF THE INVENTION

1. Field of the Invention

This invention relates to the press fabrics used in the press section of papermaking and similar machines to support, carry, and dewater the wet fibrous sheet as it is being processed into paper. The invention more specifically relates to open-ended press fabrics which are closed to assume an endless form by means of a pin seam during installation on the papermachine. It particularly relates to the use of unique yarns for the machine direction (MD) strands of the press fabric.

2. Description of the Prior Art

Endless fabrics are key components of the machines used to manufacture paper and similar products. In the present discussion, the fabrics used in the press section will be of primary concern. Not only do those fabrics function as a form of conveyor belt carrying the wet fibrous sheet being processed into paper through the press section, but, more importantly, they also accept water that is mechanically pressed from the sheet as they pass together through the presses.

At one time press fabrics were supplied only in endless form; that is, they were woven in the form of an endless, seamless loop. This was, in part, made necessary by the limitations of seaming and weaving technology. In addition, however, conditions in the press section present additional special requirements that would have to be satisfied in a workable seamed press fabric.

Historically, most of the methods for joining the ends of open papermachine fabrics, especially those used on the drying section of the machine, involve a seam which is much thicker than the rest of the body of the fabric. Such a seam would prove to be totally unworkable for a fabric used in the press section. A seam, thicker than the body of the fabric whose ends it joins would be subjected to elevated compressive forces on each passage through the press nip. This repetitive stress would weaken the seams and lead to reduced fabric life. Of potentially more serious consequence would be the vibrations set up on the press machinery by repetitive passages of the thicker seam region. Finally, the wet fibrous sheet, still quite fragile in the press section because of its high water content, can be marked, if not broken, where it comes into contact with a seam, because of these elevated forces of compression.

Despite these considerable obstacles, it remained highly desirable to develop an on-machine-seamed (OMS) press fabric, because of the comparative ease and safety with which it can be installed on the machine. This simply involves pulling one end of the open-ended press fabric through the machine, around the various guide and tension rolls and other components. Then, the two ends can be joined at a convenient location on the machine and the tension adjusted to make the fabric taut. In fact, a new fabric is usually installed at the same time as an old one is removed. In such a case, one end of the new fabric is connected to an end of the old fabric, which is used to pull the new fabric into its proper position on the machine.

By way of contrast, the installation of an endless fabric on a press section is a difficult and time-consuming undertaking. The machine must be shut down for a comparatively longer period while the old fabric is cut out or otherwise removed. The new fabric then must be slipped into proper position from the side into the gaps between the presses through the frame and-around other machine components. The difficulty of this procedure is further compounded by the fact that the newer press fabrics are gradually becoming thicker and stiffer. These characteristics add to the time and effort required on the part of plant personnel to install a new one. In this connection, a workable on-machine-seamable press fabric was an advance long sought by the industry.

Seamed press fabrics have now been in use for several years. One method to produce an open-ended fabric, that can be joined on the paper machine with a pin seam, is to weave the fabric in such a way that the ends of the machine direction (MD) strands can be turned back and woven into the body of the fabric and parallel to the machine direction. Such a fabric can be referred to as having been "flat" woven. This provides the loops needed to form the pin seam, so called because it is closed by means of a pin, or pintle, passed through the space defined by the alternating and intermeshing loops of machine-direction (MD) yarn at each end of the fabric when the ends are brought into close proximity to each other during closure.

Another technique employs the art of weaving "endless", which normally results in a continuous loop of fabric. However, when making a pin-seamable press fabric, one edge of the fabric is woven in such a way that the body yarns form loops, one set of alternating loops for each end of the woven cloth. In using either of these techniques, the seam region is only slightly thicker than the main body of the fabric, because the loops themselves are formed using machine direction (MD) yarns. This makes the pin seam a workable option for closing a fabric to be used on a press section.

Single monofilament strands have normally been used in both the machine and cross-machine directions of seamable press fabrics. The relative stiffness of monofilament ensures that it will have the requisite good loop formation properties. Experience has shown, however, that monofilament is difficult to weave and has insufficient elasticity in the machine direction for many kinds of contemporary presses. Tensile failure and seam breakage have been frequently observed.

Another difficulty is presented by the very open, rigid, incompressible structure of base fabrics woven from monofilament. For some papermaking applications, this incompressibility is not a problem, and may even be ideal. However, for positions that have poor auxiliary fabric dewatering capacity, or produce mark-sensitive sheets, a softer, more compressible base fabric is needed.

Historically, a more compressive base fabric would have been achieved by weaving with multifilament yarn, rather than monofilament. Yet, these yarns do not have the rigidity necessary for good loop formation or to maintain the integrity of the seam area during loop meshing when closing the seam upon installing the fabric on a papermachine.

The present invention is designed to overcome this shortcoming of multifilament yarn by providing a yarn which has the characteristics needed for good loop formation and meshing during seaming as well as compressibility and elasticity in the machine direction.

SUMMARY OF THE INVENTION

The present invention provides a coated multifilament yarn for use in weaving on-machine-seamable press fabrics. The coating provides the yarn with a rigid, monofilament-like structure. When used in the machine direction during the weaving of OMS press fabrics by either "flat" or "endless" techniques, this structure will permit the formation of good loops for ready intermeshing during seaming. At the same time, the multifilament characteristics of the yarn contribute to the production of a fabric having the desired properties of compressibility and MD elasticity.

A multifilament yarn is twisted to give body to the yarn and to hold together the very fine filaments of the yarn. As such, it can be understood to be composed of a number of individual filaments so joined together. On the other hand, monofilaments, as its name would imply, are strands of yarn used singly. A monofilament strand, of course, must be typically a good deal-thicker than the filaments in a multifilament yarn. Typically, monofilament has a diameter in the range between 4 and 20 mil (thousandths of an inch), or 80 denier and above. Filaments in a "pure" multifilament yarn are individually of a diameter substantially below this range, usually 6 denier and below.

The coatings can be applied to the multifilament yarns in a number of ways. Spraying the coating on the strand in liquid form, dipping the strands in the liquid coating by passing it through a vat, an emulsion coating process or a cross-head extrusion process are all effective ways of applying the coating to produce the yarn of the present invention.

Coated yarns have been shown in several prior-art patents. For example, U.S. Pat. Nos. 4,489,125 and 4,533,594 show batt-on-mesh press fabrics wherein the mesh layer is a fabric woven from machine-direction and cross-machine direction yarns. The cross-machine direction yarns in both of these patents are said to be coated in order to provide, among other properties, increased abrasion resistance. U.S. Pat. No. 4,520,059 shows a batt-on-mesh press fabric having a mesh layer which includes coated yarns in both the machine and cross-machine directions. None of these references refers to using a coated yarn in the machine direction in a seamable press fabric.

Experience with the yarns shown in these references has proven them to be unsuitable for the practice of the present invention. The yarns have insufficient rigidity for good loop formation. Their size and weight would severely limit application in the field. Finally, the coatings shown in these references easily peel off the yarn cores, even though the coating was designed to be permanent. It is difficult to predict when the coating will come off, and whether this will occur uniformly along the length of the yarn at the same rate. In addition, the coating comes off in relatively large pieces, instead of gradually wearing away or dissolving. In the papermaking process, this would lead to "plastic" contamination and present a serious problem.

In the present invention, the coatings could be permanent, semi-permanent, or soluble depending on the application of the fabric woven from the coated yarn. The primary purpose of the coating is to provide a multifilament yarn capable of forming loops of sufficient rigidity for seaming. However, a permanently coated multifilament yarn in an OMS press fabric would give it the incompressibility normally provided in fabrics woven from monofilament and at the same time provide the MD elasticity provided by a multifilament yarn. On the other hand, the use of a soluble coating material would allow it to be dissolved and washed out of the fabric once it had been seamed on the machine. In this way, an on-machine-seamable press fabric could be provided for those applications requiring a more compressible fabric than that obtainable with monofilament. Examples of such applications, as noted earlier, would be on machine positions that have poor auxiliary fabric dewatering capacity or where mark-sensitive papers are being produced.

The yarn of the present invention also provides the advantages associated with multifilament yarns such as superior abrasion resistance and a reduced susceptibility to flex-fatigue when compared to those characteristic of single, plied, braided or knitted monofilament.

BRIEF DESCRIPTION OF THE DRAWINGS

The present invention will now be discussed in more exact detail in the following "Detailed Description of the Preferred Embodiment" with reference to the accompanying figures wherein.

DETAILED DESCRIPTION OF THE PREFERRED EMBODIMENT

Figure 1:
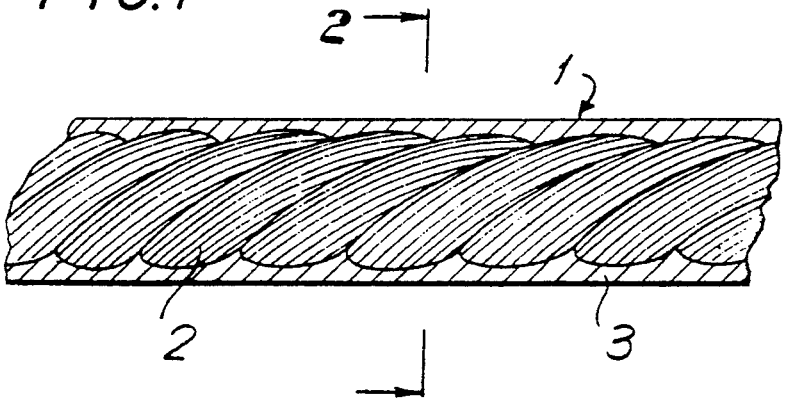
FIG. 1 is a side view of a strand of coated multifilament yarn for use in accordance with the present invention.

The unique yarns of the present invention can be illustrated as in FIG. 1. There, the yarn 1 is represented as a multifilament, consisting of a plurality of individual filaments 2 of individual diameter smaller than that which would be typical for monofilaments. The multifilament yarn 1 can be twisted, as shown by the orientation of the filaments 2. The yarn 1 has been coated, in accordance with this invention, and the coating 3 can be seen between the individual bundles or plies of filaments 2 where it functions to hold the filaments 2 in the yarn 1 together in a rigid structure. This enables the multifilament yarn 1 to be formed into good loops for the formation of a pin seam.

Figure 2:
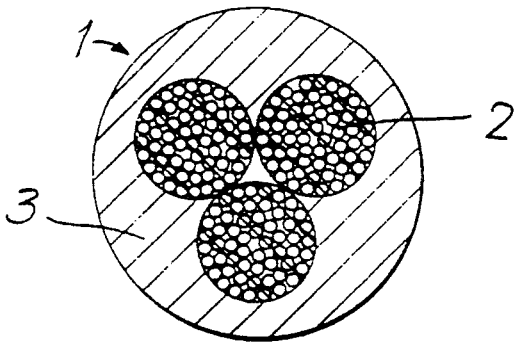
FIG. 2 is a cross-sectional view of the multifilament yarn shown in FIG. 1, taken at the point indicated in that figure.

In FIG. 2, the same strand of coated multifilament yarn 1 is shown in cross section. It can be seen to be composed of three plied bundles of filaments. Usually, there are about 100 filaments in each bundle. However, this should in no way be interpreted as a limitation on the type of multifilament, or yarn in general, to which this invention can be applied. The coating 3 can again clearly be seen between the individual bundles of filaments 2, where it serves the purpose of holding the bundles of filaments 2 together in a monofilament-like structure.

Figure 3:
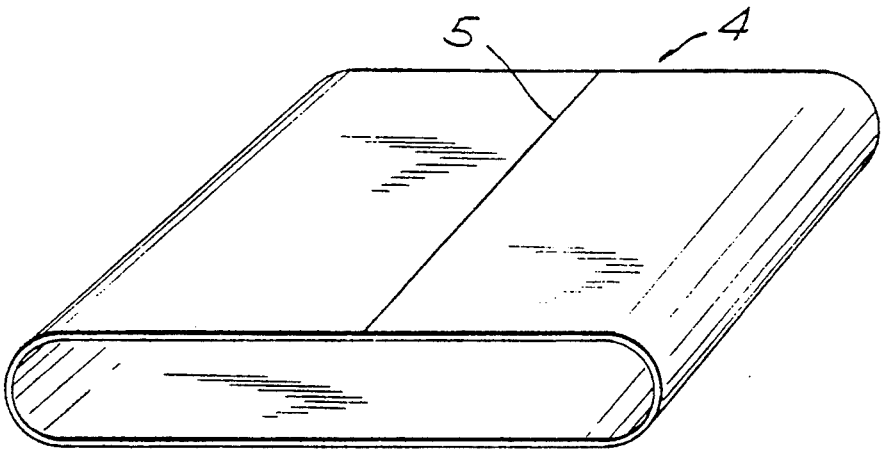
FIG. 3 is a schematic view of a seamed press fabric of the present invention.

FIG. 3 is a schematic view of a press fabric 4 woven from the unique yarn of the present invention. The yarn 1 is particularly designed for use as the machine direction (MD) system of yarns which are used to form the loops used to seam the fabric. However, they can also be used in the cross-machine system, if the needs of the given application so dictate. Note also the seam 5, which is closed by means of a pin seam as discussed earlier.

Figure 4:
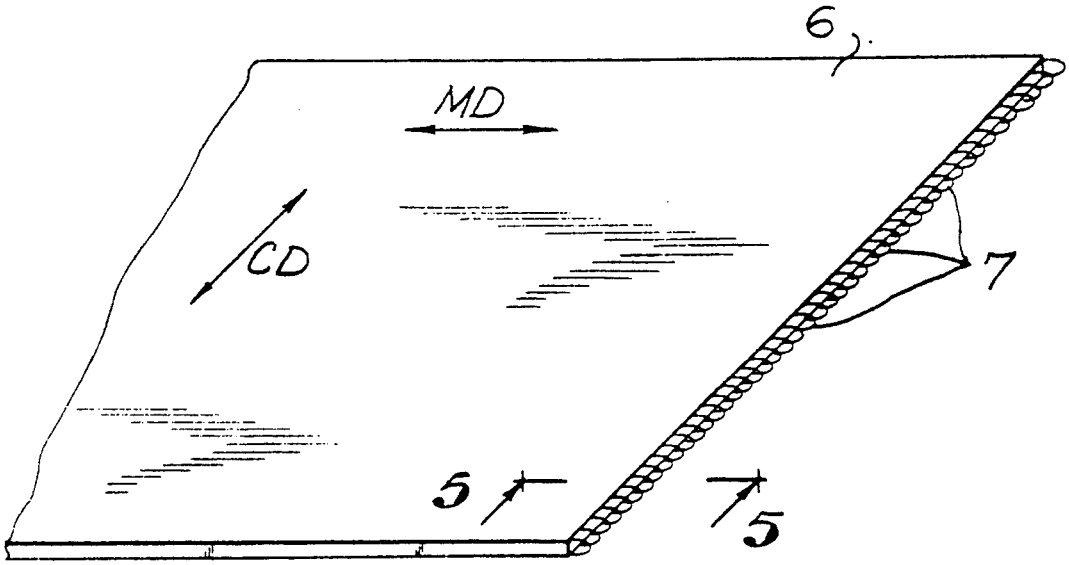
FIG. 4 is a plan view of one end of an OMS press fabric prior to seaming.

FIG. 4 is a plan view of an end of an on-machine-seamed (OMS) press fabric 6 prior to being installed on a papermaking machine. Loops 7 formed by machine direction (MD) yarns can be seen along the right hand edge of the end of the press fabric 6. Machine direction and cross-machine direction are as indicated in the FIG. 4 by MD and CD respectively.

As stated earlier, loops can be formed using machine direction (MD) yarns by either one of two techniques: "flat" weaving, where the ends of the MD strands are woven back into the fabric to form loops, and modified "endless" weaving, where the machine direction yarn is continuous, running back and forth for the length of the fabric, forming loops at each end.

Figure 5:
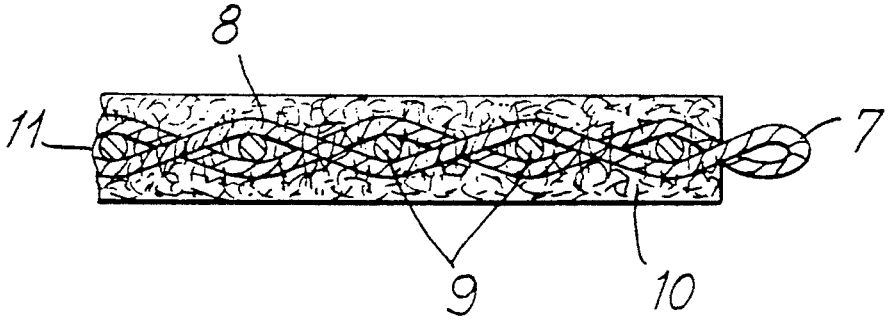
FIG. 5 is a view taken in cross section where indicated in FIG. 4 for the case where the fabric has been woven in "flat" form.

In FIG. 5, a cross-sectional view taken at the point and in the direction indicated in FIG. 4, a loop 7 formed in a fabric which has been "flat" woven is shown. The machine direction (MD) yarn 8 is the coated multifilament yarn 1 of the present invention and forms the loop 7, as described above. The cross-machine direction (CD) yarn 9 can also be the coated multifilament yarn 1 of the present invention if desired or if the needs of a given papermachine application so require, but is shown in FIG. 5 as a monofilament. Also shown is a fibrous batt 10 which has been needled into the structure of the base fabric 11 woven from the machine direction (MD) yarns 8 and cross-machine direction (CD) yarns 9.

As noted above, the present invention provides a coated multifilament yarn for use as the machine direction (MD) yarns in on-machine-seamable press fabrics. The core of the coated yarn is preferably a multifilament, or spun, yarn, having individual filaments of 6 denier or less. In this way, the coated yarn will have the machine direction (MD) elasticity of a multifilament yarn and the good loop formation characteristic of a monofilament. However, filaments of denier greater than 6 can be used as well as yarns, having diameters in the monofilament range, that are plied together in some combination. In these instances also, the application of a coating will help loop integrity to improve seaming.

One of the benefits of the present invention is that it permits the use of a multifilament yarn in the machine direction of an on-machine-seamable press fabric. A yarn of this type is far more capable of withstanding the repeated flexings encountered during operation on a papermachine without catastrophic breakage. This point can be appreciated by referring to the following flex fatigue table:

| Flex Fatigue | |
|---|---|
| Yarn Type | Cycles before Failure |
| 0.040" mono | 6500 max |
| 0.008" plied mono (2 × 3) | 7000 max |
| coated multifilament | 22000 max |
| 6 denier multifilament (105 filament bundle) | over 300,000 max |

The above measurements were made on a flex fatigue device which simulates the repeated flexings encountered by the machine direction (MD) yarn in a papermachine fabric. The superiority of a multifilament yarn in this respect is clear.

A new material, which can be extruded in either monofilament or multifilament form, has recently been used for the yarns of the present invention. The material is unique in that it is thermoplastic. If this were used to manufacture a plied or multifilament yarn, and the yarn woven into a base fabric and heat set at appropriate temperatures, the outside of the yarn would "melt" and flow. When viewed in cross section, the yarn structure that results has an appearance like that shown in FIG. 2. The heat-setting treatment does not cause the yarn to lose any other textile property, such as strength or elongation. The yarn does not have a bicomponent or sheath-core construction. The material used is a special polyamide resin called MXD6, available from Mitsui in Japan.

For coated yarns of the present invention, the coatings can be applied by dipping, Spraying, by an emulsion process, or by cross-head extrusion. The latter refers to a process whereby a coating is applied to a core by passing it through an extruder. The coating is therefore of fixed diameter, and forms a "sleeve" over the core. The core is usually already manufactured and could be of any yarn form, such as monofilament, plied monofilament, or multifilament. However, the core and the sleeve could be manufactured in consecutive steps. In either case, the core must be of a higher melting temperature than the sleeve so that it will not degrade during the coating process. That is to say, the core yarn is of a synthetic polymeric material of any of the varieties commonly used to produce the yarns from which papermachine clothing is woven. Representative varieties are polyamide, polyester, polyimide, polyolefin, and polyethylene terephthalate (PET).

The coatings themselves can be permanent, semipermanent, or soluble. Permanent coatings are so called because they last for the operating life of the fabric. The purpose of such a coating is to achieve some desired degree of resiliency, that is, an ability to return to nearly original caliper following the removal of an applied load. The preferred coating materials are resinous lattices, such as those composed of acrylic, epoxy, urethane, and other "elastomeric" polymers, or combinations of materials. What makes the coating permanent is that it is cured after being applied to and dried on the core yarn. Examples of substances suitable for use as permanent coatings are urethanes, such as Goodrich's BFGU 024 and BFGU 017, and acrylics, such as Goodrich's 2600×315 and 2600×288.

Semi-permanent coatings last for a portion of the lifetime of the press fabric. Material from the same families as those of the permanent coatings can be used, but, in general, semi-permanent coatings are not as hard as permanent ones. This is because the coating is not cured after it has been applied to and dried on the core yarn. The omission of the curing step results in a far less durable resin coating. While hard when dry, such a coating tends to soften when wet and dissolves over a period of time on the order of days or weeks. An example of such a material is B. F. Goodrich Hycar 26120 acrylic resin. The substances listed above for use as permanent coatings may also be used, so long as they are not cured after application onto the core yarns.

Soluble coatings are applied using materials that are readily soluble in water, and usually do so within hours after a press fabric incorporating them is installed on a papermaking machine. When dry, they form a nice, relatively stiff coating, sufficient for good loop formation and easy seaming. Examples of soluble coatings are polyvinyl alcohol (PVA) and calcium alginate.

Modifications to the above would be obvious to one skilled in the art without departing from the scope of the invention as defined in the appended claims.

What is claimed is:

1. An open-ended press fabric, for use on the press section of a papermaking machine, and designed for pin-seam closure, comprising:

a system of machine-direction (MD) yarns and a system of cross-machine direction (CD) yarns, said yarns of said system of machine-direction (MD) yarns being interwoven with said yarns of said system of cross-machine direction (CD) yarns to form said open-ended press fabric in a rectangular shape with a length, a width, two lengthwise edges, and two widthwise edges, said machine-direction (MD) yarns extending for said length of said open-ended press fabric between said two widthwise edges, said machine-direction (MD) yarns further forming loops along each of said two widthwise edges for joining said two widthwise edges to one another with a pin seam, said pin seam being integral to said open-ended press fabric, said machine-direction (MD) yarns extending for the length of said open-ended press fabric being composite yarns including a core yarn and having a sleeve-like coating to form a monofilament-like strand, said core yarn being of a synthetic polymeric resin, said composite yarns forming said loops along said two widthwise edges of said open-ended press fabric to facilitate the intermeshing of said loops when said two widthwise edges are brought together to form said pin seam.

2. An open-ended press fabric as claimed in claim 1 wherein said cross-machine direction (CD) yarns are composite yarns including a core yarn with a sleeve-like coating.

3. An open-ended press fabric as claimed in claim 1 further comprising a batt of staple fibers needled thereinto.

4. An open-ended press fabric as claimed in claim 1 wherein said core yarn is a multifilament yarn.

5. An open-ended press fabric as claimed in claim 1 wherein said core yarn is a spun yarn.

6. An open-ended press fabric as claimed in claim 1 wherein said core yarn is a multifilament yarn having a plurality of plied bundles of filaments.

7. An open-ended press fabric as claimed in claim 1 wherein said core yarn is a plied monofilament yarn.

8. An open-ended press fabric as claimed in claim 1 wherein said synthetic polymeric resin is selected from a group consisting of polyamide, polyester, polyimide, polyolefin, and polyethylene terephthalate (PET).

9. An open-ended press fabric as claimed in claim 1 wherein said sleeve-like coating of said composite yarns is permanent, said coating being selected from a group consisting of acrylic, epoxy, urethane, and combinations thereof, and being applied to said core yarns, dried and cured thereon.

10. An open-ended press fabric as claimed in claim 1 wherein said sleeve-like coating of said composite yarns is semipermanent, said coating being selected from a group consisting of acrylic, epoxy, urethane, and combinations thereof, and being applied to said core yarns and dried thereon, and being uncured.

11. An open-ended press fabric as claimed in claim 1 wherein said sleeve-like coating of said composite yarns is soluble, said coating being selected from a group consisting of polyvinyl alcohol (PVA) and calcium alginate.

* * * * *